United States Patent [19]

Kosmider

[11] 4,066,444

[45] Jan. 3, 1978

[54] PROCESS FOR DEOXIDIZING STEEL BY MEANS OF MOLTEN ALUMINUM

[75] Inventor: Hans Kosmider, St. Magnus, Germany

[73] Assignee: Klockner-Werke AG, Duisburg, Germany

[21] Appl. No.: 630,664

[22] Filed: Nov. 1, 1975

[30] Foreign Application Priority Data

Nov. 9, 1974 Germany ..... 2453254

[51] Int. Cl.[2] ..... C21C 7/06

[52] U.S. Cl. ..... 75/58; 75/30; 266/265; 266/216

[58] Field of Search ..... 75/58, 30; 266/265–271

[56] References Cited

U.S. PATENT DOCUMENTS 3,368,885 2/1968 Volianik ..... 75/58

FOREIGN PATENT DOCUMENTS 849,711 7/1949 Germany ..... 75/58

*Primary Examiner*—Peter D. Rosenberg
*Attorney, Agent, or Firm*—Michael J. Striker

[57] ABSTRACT

Molten steel is killed by passing molten aluminum under pressure below the surface of the steel melt through a lance heated to the melting point of the aluminum.

15 Claims, 1 Drawing Figure

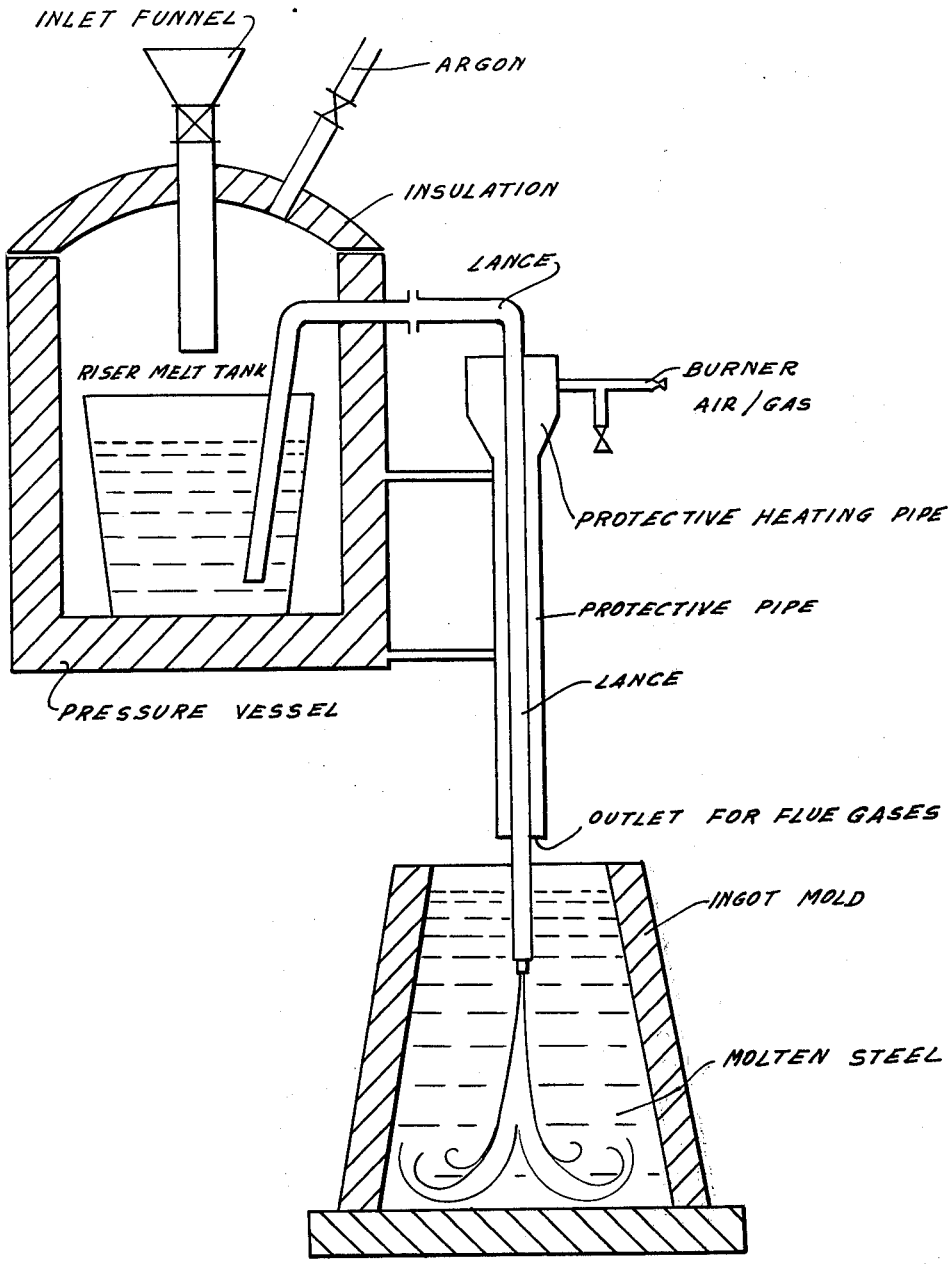
INLET FUNNEL
ARGON
INSULATION
LANCE
RISER MELT TANK
BURNER
AIR / GAS
PROTECTIVE HEATING PIPE
PROTECTIVE PIPE
LANCE
PRESSURE VESSEL
OUTLET FOR FLUE GASES
INGOT MOLD
MOLTEN STEEL

PROCESS FOR DEOXIDIZING STEEL BY MEANS OF MOLTEN ALUMINUM

Processes are already known for deoxidizing steel with molten aluminum. In these known processes an intentionally highly oxidized steel melt is killed with a sufficient amount of molten aluminum (compare German Pat. No. 849,711).

In this known process the distribution of the molten aluminum in the steel melt is unsatisfactory. The present invention has the object to obtain a better distribution of the aluminum in the steel melt to be deoxidized without impairing the effectiveness of the aluminum or the quality of the steel.

This object is solved by blowing the molten aluminum into the steel melt by means of inert gases through a lance which has been heated up to the melting point of the aluminum.

According to a preferred embodiment of the invention the inert gases are preheated.

The process of the invention is particularly of advantage for making stabilized grades of steel. Heretofore in order to obtain a thick skin the pouring had to be interrupted for one to three minutes and the added aluminum had to be passed on during further pouring by the flowing stream into the melt. The process of the invention makes it possible to fill up the mold and after an advantageous waiting time to introduce the molten aluminum into the steel from a pressure vessel. This results particularly in a better distribution of the deoxidation products at the base of the block which solidifies in the mold or of the solidifying slab. In this manner it is possible to obtain a better degree of distribution also in the ladle. Besides it has been found that this kind of product reduces the loss of aluminum.

The process if the invention can be carried out both in the ladle and in the ingot mold.

An example of the process of the invention will be discussed in the following. Generally, it is noted that the molten steel preferably is made in BOF converters or in Siemens-Martin furnace and is subsequently poured into steel ladles. To make soft, deep-drawing grades of steel, the following analysis was obtained prior to the tapping in the ladle:

C: 0.04%
Mn: 0.10–0.14%
P: 0.008–0.012%
S: 0.020–0.025%
Oxygen: about 0.08%

During the tapping in the ladle ferromanganese and aluminum are added to the soft, rimmed steel. The ferromanganese addition depends on the final analysis which will then change somewhat as to the C and Mn contents, i.e., as to C from 0.04 to 0.05–0.06% and as to Mn to 0.25–0.30%. The addition of 0.1 kg aluminum reduces the oxygen contents to about 0.07%. The rimmed steel is poured from the steel ladle into a mold and subsequently fully deoxidized by means of liquid aluminum.

With a mold of a height of 2.400 mm, a width of 1,200 mm and an average thickness of 700 mm, a block weight was obtained of about 15 tons. The steel in this case was poured into the mold at a temperature of 1560° and a speed of 10 tons per minute, i.e., a rise of 1.50 m per minute. At 3 to 4 minutes after a skin had formed at the wall of the mold consisting of rimmed steel in a thickness of about 25 mm, a lance of an inner diameter of about 11 mm was introduced into the molten steel until a depth of immersion of about 300 to 400 mm was obtained. At a pressure of 3 to 4 atmospheres above atmospheric liquid aluminum was then forced into the molten steel through the lance. This pressure was found to be necessary to reach the base of the block or mold. The amount of liquid aluminum used up was 1 kg per ton of liquid steel. The liquid aluminum at a temperature of 800° to 850° flowed through the pipe or lance at a speed of about 10 to 12 m/sec. The addition of molten aluminum was about 1.2 kg per second. In order to kill fully the 15 tons of steel with aluminum about 12 to 14 seconds were necessary. Since the block was filled with liquid steel in about 1.5 minutes, it was necessary thereafter to wait for three to four minutes before starting with the deoxidation. The entire operation consisting of the introduction of the lance, the blowing-in of the liquid aluminum and the withdrawing of the lance took about 5.5 to 6 minutes.

In the attached drawing an apparatus is illustrated by which the liquid aluminum is introduced into the steel. The liquid aluminum which for instance is received from an aluminum melting plant and is kept at an elevated temperature in a storage vessel is introduced into a melting pot at about 850° C by means of an inlet funnel with attached inlet pipe. In the melting pot a riser is provided which extends outwardly through the wall of the pressure vessel. A removable lance is fastened to this riser. The lance is surrounded by a protective pipe and is heated in the heating portion of the protective pipe by means of a burner which is fed with oil and a mixture of air or gas. Instead of the protective pipe of this kind the lance can also be clad with a ceramic mass; the lance clad with the ceramic mass is then preheated in a furnace to 600° to 700° C. The pressure in the pressure vessel was about 3 to 4 atmospheres above atmospheric. Argon was used as pressure gas. The amount of argon used up was about 20 to 30 liters per ton. It will be understood that instead of argon it is also possible to use other inert gases.

After each operation the melting pot in the pressure vessel is again filled with liquid aluminum. However, it is also possible to use larger size pressure vessels and larger size melting pots in order to treat several molds in a row with liquid aluminum.

If the steel is treated in a ladle instead of the mold the treatment generally is carried out in the same manner. However, a larger apparatus is necessary. The addition of liquid aluminum in ladles amounts to about 1.3 kg per ton of liquid steel. The lance must be immersed into the steel by at least 1,000 to 1,200 mm. In case of a ladle of 250 tons a lance is necessary of an inner diameter of 25 mm and a performance of about 7 kg aluminum per second. With this rate of introduction it is possible to completely deoxidize a 250 t ladle in 45 to 50 sec. In order to obtain a good mixture it is advantageous to place a blower into the bottom of the ladle so as to achieve a good mixture with the nitrogen or argon. The amount of scavenging gas is between 20 and 40 liters per ton of steel.

In case of a ladle process and the use of the same grade of deep drawing steel the same analysis is obtained as in case of the mold. The only difference is that the total aluminum contents after treatment is about 0.070%, while the contents of metallic aluminum cluding aluminum nitrite is about 0.040 to 0.050%. The pressure by which the argon forces the aluminum into the ladle is about 4 to 5 atmospheres above atmospheric in case of a large ladle.

The term "ton" as used before always refers to metric tons.

I claim:

1. The improvement in the process for deoxidizing steel melts by means of molten aluminum, the said improvement comprising blowing the molten aluminum under pressure into the steel melt through a lance which has been preheated to at least about the melting point of the aluminum.

2. The improvement in the process for deoxidizing steel melts by means of molten aluminum, the said improvement comprising blowing the molten aluminum under pressure into the steel melt through a lance extending below the surface of the melt, the lance being preheated to at least about the melting point of the aluminum.

3. The improvement of claim 2 wherein the blowing is effected by means of inert gases under pressure.

4. The improvement of claim 3 wherein the inert gases are argon or nitrogen.

5. The improvement of claim 3 wherein the inert gases are preheated.

6. The improvement of claim 2 wherein the molten steel is poured into a mold and the molten aluminum is blown below the surface of the melt after a substantially solidified skin of rimmed steel has formed on the walls of the mold.

7. The improvement of claim 2 wherein about 1 kg molten aluminum is employed per ton of steel.

8. The improvement of claim 2 wherein the molten aluminum is introduced at a flow speed of about 10 to 12 m/sec and in an amount of about 1.2 kg per second.

9. The improvement of claim 2 wherein the lance is preheated to about 600° to 700° C.

10. The improvement of claim 2 wherein the molten aluminum is introduced into the steel while the steel is still in the ladle where it was received from the converter or Siemens-Martin furnace.

11. The improvement of claim 2 wherein the pressure applied to the moten aluminum is about 3 to 4 atmospheres above atmospheric in the case where the steel is deoxidized in the mold and wherein the said pressure is about 4 to 5 atmospheres above atmospheric in the case where the steel is deoxidized in the ladle.

12. The improvement of claim 2 comprising adding ferromanganese or aluminum to the steel melt received in the ladle from the converter or Siemens-Martin furnace so as to slightly reduce the oxygen contents of the steel whereupon the molten rimmed steel is poured into a mold where a skin of rimmed steel is pemitted to form along the walls of the mold whereupon the preheated lance is immersed below the surface of the melt and the molten aluminum is introduced under pressure into the steel in an amount sufficient substantially to deoxidize the steel.

13. An apparatus for deoxidizing steel in the melt by means of molten aluminum, the apparatus comprising a pressure vessel;

an inlet for the molten aluminum;

a second inlet for an inert pressure gas;

a mold for receiving the molten steel from the converter or Siemens-Martin furnace;

a lance leading from the pressure vessel into the steel mold, and means for heating the lance along a predetermined part of its length outside said pressure vessel.

14. The apparatus of claim 13 wherein the heating means for the lance include a heating pipe arranged coaxially about said lance along said part of its length and terminating short of said mold and means for introducing a gaseous heating medium into said heating pipe.

15. The apparatus of claim 13 in which the lance is in the form of a syphon-type riser extending through the wall of said pressure vessel, the short arm of the syphon extending into the higher level pressure vessel and the long arm extending into the lower level mold.

* * * * *